United States Patent [19]

Koepke et al.

[11] 4,384,015

[45] May 17, 1983

[54] PROCESS AND AN APPARATUS FOR SIMULTANEOUSLY COATING SEVERAL LAYERS TO MOVING OBJECTS, PARTICULARLY WEBS

[75] Inventors: Günther Koepke, Odenthal; Hans Frenken, Odenthal-Osenau; Heinrich Bussmann, Cologne; Kurt Browatzki, Leverkusen, all of Fed. Rep. of Germany

[73] Assignee: Agfa-Gevaert AG, Leverkusen, Fed. Rep. of Germany

[21] Appl. No.: 299,534

[22] Filed: Sep. 4, 1981

Related U.S. Application Data

[63] Continuation of Ser. No. 135,697, Mar. 31, 1980, abandoned.

[30] Foreign Application Priority Data

Apr. 3, 1979 [DE] Fed. Rep. of Germany ..... 2913217

[51] Int. Cl.[3] ..... B05D 1/30; B05D 1/34

[52] U.S. Cl. ..... 427/402; 118/DIG. 4; 118/325; 427/420; 430/935

[58] Field of Search ..... 427/420, 402; 118/DIG. 4, 50, 325; 430/935

[56] References Cited

U.S. PATENT DOCUMENTS

| | | | |
|---|---|---|---|
| 3,341,354 | 9/1967 | Woods et al. | 117/105.3 |
| 3,365,325 | 1/1968 | Fraenkel et al. | 118/DIG. 4 |
| 3,508,947 | 4/1970 | Hughes | 117/34 |
| 3,593,677 | 7/1971 | McLain | 118/206 |
| 3,867,901 | 2/1975 | Greiller | 118/50 |
| 3,973,062 | 8/1976 | Fahrni | 427/420 |
| 4,019,906 | 4/1977 | Ridley | 96/68 |

FOREIGN PATENT DOCUMENTS

| | | | |
|---|---|---|---|
| 2351902 | 4/1974 | Fed. Rep. of Germany | 118/DIG. 4 |

*Primary Examiner*—Shrive P. Beck

*Attorney, Agent, or Firm*—Connolly and Hutz

[57] ABSTRACT

The invention relates to an apparatus and process for simultaneously coating several layers to moving objects, particularly webs, whereby at least two liquid coating materials issue over the width of V-shaped sliding surfaces or above following sliding surfaces are delivered to the two sliding surfaces which are arranged in the form of a V and which form a discharge edge above the objects or web to be coated, flow down the underside of the V-shaped sliding surfaces, combine at the end of the sliding surfaces to form a multiple layer film of liquid which is deposited in the form of a free falling curtain onto the objects or the web of layer support material.

5 Claims, 6 Drawing Figures

PROCESS AND AN APPARATUS FOR SIMULTANEOUSLY COATING SEVERAL LAYERS TO MOVING OBJECTS, PARTICULARLY WEBS

CROSS REFERENCE TO RELATED APPLICATIONS

This application is a continuation of parent application Ser. No. 135,697, filed Mar. 31, 1980 by the same inventors, now abandoned.

This invention relates to a process and an apparatus for simultaneously coating several layers of liquid coating materials to objects or webs of layer-support materials which move continuously past the point of application, particularly for the production of photographic materials.

BACKGROUND OF THE INVENTION

In the photographic industry, webs of paper and film have for some time been simultaneously coated with several layers.

Multilayer coating processes of the type commonly used in the photographic industry include the so-called cascade coating process in which one or more liquid coating materials simultaneously flow down an inclined sliding surface and are coated on the moving web through a narrow gap (0.15–0.3 mm) between the edge of the coater and the web. In addition, the so-called curtain coating process has recently been gaining significance in the photographic industry. There are two versions of the curtain coating process, namely the so-called slot coaters and the so-called nozzle coater or sliding surface coater operating on the same principle as the cascade coater. In slot coaters, the coating material issues at the lower end of an outflow gap arranged transversely above the web to be coated where it directly forms a free-falling curtain. By contrast, in nozzle coaters or sliding-surface coaters, the coating material is forced through an outlet slot onto an inclined sliding surface, flows under the force of gravity down this sliding surface, which is arcuate or nozzle-shaped at its lower end, and only forms the free-falling curtain at the lower end of the nozzle, i.e. on leaving the nozzle. In both cases, the liquid curtain may consist of one or more layers.

The cascade coating process is limited in its scope of application and is attended by a number of disadvantages. Neither is it suitable for coating individual objects because their edges would disturb the coating process.

Thus, the gap between the edge of the coater and the web has to be kept relatively narrow (0.15 to 0.3 mm), so that, on the passage of a joint or if the edges of the moving web are slightly frayed, the web as a whole is torn. In addition, particles of dust can easily be left behind in the critical region of the coating edge, giving rise to so-called pencil lines in the layer applied.

In addition, on the passage of joints, so-called coating breaks can occur on account of the above-mentioned narrow gap. Furthermore, the coating material leaving the coater forms a meniscus at the inlet end of the web which is drawn more or less deeply into the gap between the edge of the coater and the web, depending on the vacuum applied to assist the coating process. The coating material is not replaced in this meniscus at the edge of the coater, with the result that partial hardening or thickening (through evaporation of the volatile constituents) occurs there. This also leads to the well-known pencil lines. Similar consequences arise from an irregular wetting line. Finally, the coating speed in this conventional process has an upper limit which depends on the number of layers, the quantities applied and the viscosities of the coating materials.

The above-mentioned conventional curtain coating process using slot coaters or nozzle coaters has been described in various forms and with various apparatus which show that it is possible in this way to produce single-layer and multiple-layer coatings at high speed. However, these processes and apparatus are also attended by serious disadvantages.

Thus, the curtain coating system using a slot coater is limited to two-layer coatings. When filled with the coating material, the slot coater is difficult to vent so that small bubbles give rise to faults in the layer applied during production.

In both the nozzle coater and the slot coater, disturbances attributable to unequal wetting of the discharge lips, deposits of dust and partial hardening and thickening of the coating material originate at the discharge lip at which the curtain is formed (in the same way as the coating edge of cascade coaters). In practice, this leads to faults such as pencil lines, breaks in the curtain, etc. In the event of disturbances such as these, production has to be stopped and the discharge lips have to be cleaned and re-aligned. Thus, in addition to the loss of production time, considerable losses of material occur in high-speed multi-layer coating.

In addition, where the nozzle coater is used, the two surfaces of the curtain have different surface tensions because one surface, namely the layer remote from the sliding surface, is always in contact with the atmosphere for a longer period. Since the surface forces are unequal, the curtain can become unstable. The surface-active additives introduced into the coating material also act differently, according to the medium with which they are in contact. In the case of slot coaters, both surfaces are simultaneously exposed to the atmosphere during formation of the curtain. In nozzle coaters, one surface is in contact with the atmosphere for a longer period than the other surface.

German Offenlegungsschrift No. 2,351,369 (corresponding to U.S. Pat. No. 3,973,062) describes a coating system which is based on a combination of two nozzle coaters. Each of the two nozzle coaters produces up to two liquid films which, together with the liquid films produced by the other nozzle coater, form a curtain which drops vertically onto the web to be coated. In addition to the two nozzle coaters, this known coating system contains a third component consisting of a prismatic body of which the cross-section is in the form of an equilateral triangle. One longitudinal edge of the prismatic body, the so-called discharge edge, lies above the gap formed by the lips of the two nozzle coaters. One layer of liquid coating material flows over each of the two surfaces forming the discharge edge of the prismatic body. At the discharge edge, the two layers form a double layer which drops as a curtain between the layers supplied by the two nozzle coaters and combines to form a multiple layer which then flows down onto the web to be coated in the form of a free falling curtain.

In this case, a multiple layer is applied by means of a relatively complicated system. The coating system has the same disadvantages as the known nozzle coaters. In addition, three coaters are required for only five layers.

They are very difficult and expensive to operate. Owing to the intermediate application of two layers in two layers, there is a considerable danger of air being trapped inside the layers. The faults mentioned in reference to nozzle coaters, such as pencil lines caused by deposits of dust, evaporation residues and irregular wetting lines, occur on the front and back of the curtain.

An object of the present invention is to provide a simplified process and an apparatus for simultaneously applying several layers of liquid coating materials to objects, particularly webs acting as layer supports, which enables a simple and compact structure to be obtained and which avoids the above-mentioned disadvantages of conventional processes and apparatus.

SUMMARY OF THE INVENTION

According to the invention, this object is achieved in that, in a coating machine, at least two liquid coating materials issue over the width of V-shaped sliding surfaces or above following sliding surfaces, are delivered to the two sliding surfaces which are arranged in the form of a V and which form a discharge edge above the objects or web to be coated, flow down the underside of the V-shaped sliding surfaces, combine at the end of the sliding surfaces, i.e. at the discharge edge, to form a multiple-layer film of liquid, and the multi-layer film is deposited in the form of a free-falling, laterally guided curtain onto the objects or the web of layer-support material.

In one simple process, at least one liquid coating material issues from each of the V-shaped sliding surfaces and flows down the underside of the V-shaped sliding surface.

One preferred embodiment of the process is distinguished by the fact that the liquid coating materials issue from another two vertical or sloping roof-like sliding surfaces, flow down the underside of these sliding surfaces to the V-shaped sliding surfaces and, over them, to the discharge edge where they form a common curtain.

In one special process for two layers, two liquid coating materials flow over the edges of a V-shaped, centrally divided container extending over the width of the web onto the V-shaped sliding surfaces, flow down the underside of these V-shaped sliding surfaces and combine to form a curtain at the discharge edge.

One surprising aspect of the process according to the invention is that several coating materials are held by adhesion forces on the underside of a surface without separating in the quantities required for the production of photographic materials.

Another surprising aspect is that the curtain formed by the process according to the invention is highly stable. When the coating materials merge with one another, the layers are not mixed, neither—unexpectedly—are any coating streaks formed.

In the process according to the invention, it is important for the curtain to be protected against movements of air from the surrounding atmosphere and against the air entrained by the web both during its free fall and also when it comes into contact with the layer support.

The present invention also provides an apparatus for carrying out the process according to the invention, comprising a coating unit arranged above the continuously moved objects or layer supports to be coated for producing a multiple-layer curtain, characterised in that, for combining at least two liquid coating materials at a common discharge edge, two sliding surfaces arranged in the form of a V are provided at angles of $\alpha_3$ and $\alpha_4$ relative to the horizontal and in that at least one chamber-like feed passage with outlet slots for the liquid coating materials is provided on or above either side of the V-shaped sliding surfaces.

One embodiment of the apparatus is characterised in that the coating unit comprises V-shaped bodies with V-shaped sliding surfaces and a discharge edge extending at least over the coating width and delivery means for accommodating up to 6 or even more chamber-like feed passages and slots for the liquid coating materials.

A preferred embodiment of the apparatus comprises delivery means for the coating materials with vertical sliding surfaces for delivering the liquid coating materials to the V-shaped sliding surface, the outlet slots being horizontally arranged.

Another embodiment of the apparatus is distinguished by the fact that the delivery means for coating materials comprise sloping roof-like sliding surfaces for delivering the liquid coating materials to the V-shaped sliding surface, the outlet slots sloping upwards. In this way, the slots are made considerably easier to vent so that no troublesome air bubbles are formed.

In another advantageous embodiment of the apparatus, the delivery means for the coating materials are designed in such a way that, on the one hand, a less inclined roof-like sliding surface is present for discharging and superposing the coating materials and a central delivery element comprises a curved sliding surface which connects the roof-like inclined surface to the vertical and which, on one side of the V-shaped body, is connected to the V-shaped sliding surface whilst, on the other hand, there is at least one delivery passage and outlet slot which delivers at least one other liquid coating material to the other sliding surface of the V-shaped body. This apparatus has the advantage of a cascade-like discharge surface for any number of coating liquids and of forming the curtain at a discharge edge which is completely sealed off from the atmosphere by another layer of a coating material.

One simple apparatus for a plurality of layers is distinguished by the fact that the entire coating unit is V-shaped and the outlet slots are arranged horizontally in the V-shaped sliding surfaces.

An embodiment of the apparatus which is simple to produce, maintain and operate is distinquished by the fact that it consists of a centrally divided V-shaped container, the coating materials flowing onto the V-shaped sliding surfaces across overflow barriers. Accordingly, this arrangement can only be used for two-layer coating.

One advantageous and extremely versatile apparatus is characterised in that the entire coating unit can be moved so as to adjust the height of flow a of the curtain 3 to a vertical distance of about 1 to 20 cm from the coating surface 1.

The fact that the coating unit can be pivoted about the discharge edge enables the quality of coating to be optimised in that the discharge surfaces of the entire coating unit can be varied and adapted.

The apparatus is advantageously arranged in such a way that the material to be coated, i.e. the layer support, is supported by suitable means, preferably by a roller, at the point of contact of the curtain. In this way, the layer support is stabilized at this point, thereby avoiding any irregularities in the layers applied.

One advantage common to all the embodiments described above lies in the absence of a discharge lip. In every case, the coating edge is completely surrounded by the coating materials. This avoids the disturbances and losses which occur at the discharge lips of slot coaters and nozzle coaters. It must be regarded as surprising to the expert that several layers are able to adhere to the underside of a surface and to flow downwards to the coating edge.

Another unexpected result is the improvement in the stability of the curtain which is presumably attributable to the symmetry of the flow conditions prevailing at the coating edge S and to the relatively long period for which the two surfaces of the coating materials are in contact with the atmosphere. The surface-active additives present in the coating materials have enough time to concentrate in the two surfaces and, hence, to reduce the surface tensions.

The processes and apparatus according to the invention afford a significant technical advance. The output of the coating machines is improved because the greater stability of the curtain prevents it from breaking, thereby avoiding production stoppages. In addition, the absence of discharge lips avoids the relatively high losses which would otherwise be caused through hardening of the coating material, deposits of dirt, thickening and unequal wetting. Particular economy is obtained by virtue of the fact that large numbers of layers can be applied in a single passage. Further advantages of the invention lie in the fact that the coater is very simple and compact in construction and easy to handle.

BRIEF DESCRIPTION OF THE DRAWINGS

Various embodiments of the invention are described in detail in the following with reference to the accompanying drawings, in which.

DESCRIPTION OF THE PREFERRED EMBODIMENTS

Figure 1:
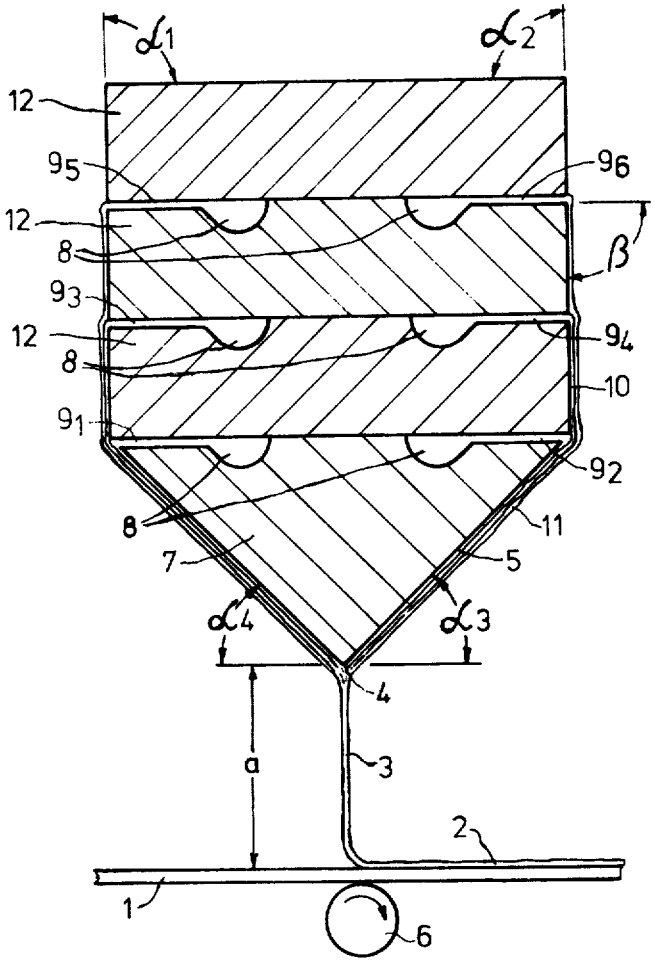
FIG. 1 is a section through the coating unit with vertical sliding surfaces.

FIG. 1 is a central section through a coating unit or coater according to the invention. The coater consists of the blocks 7 and 12 which are screwed to one another and bounded by end plates. The end plates and the means by which the coater is fixed to a frame are not shown. The liquid coating materials 11 are introduced into the feed passages 8 from one side by means of conventional metering pumps and pipes which will not be described any further here. The feed passages 8, which may also be in several stages, together with the adjoining outlet slots $\mathbf{9}_{1\text{-}6}$ ensure that the coating materials are uniformly distributed over the coating width. As in conventional coaters, the feed passages 8 may be equipped with distributing pipes and/or with feed passages having different dimensions over the width.

The coating materials issuing from the outlet slots 9 flow down the vertical surfaces and are superposed on the coating materials already flowing downwards from the lower slots. Finally, they are diverted by adhesion forces to the sliding surfaces 5 negatively inclined at the angles $\alpha_3$ and $\alpha_4$ and flow down the underside of these sliding surfaces to the discharge edge 4 where they form a common curtain 3. The curtain 3 is held by curtain guides (not shown) at both its edges.

The coating width may be adjusted for any practical web width. The absence of discharge lips is particularly favourable in the case of wide webs because the probability of disturbances of the kind referred to above occurring at one or more points of the discharge lips of a nozzle coater increases with increasing coating width.

The curtain 3 is formed at the discharge edge 4 and, after the height of fall a, comes into contact with the moving layer support 1 and coats it over its entire width, the surplus coating material being diverted into collecting troughs at the edges. The webs thus formed do not have to be cut along their edges.

However, the layer support 1 is advantageously only coated to just short of its edges because, as known and already mentioned, the curtain 3 is guided by curtain guides extending to just short of the moving layer support 1 and is therefore prevented from contracting through surface tension. In this way, less valuable coating material is lost and the coated layer support 1 is not coated over its entire width and has to be trimmed, the uncoated edges being cut off.

An important feature of the invention is the V-shaped body 7 with its V-shaped sliding surfaces 5 which meet at the discharge edge 4. The liquid coating materials 11 flow down the undersides of these sliding surfaces 5 on both sides and combine at the discharge edge 4 to form a curtain 3. The V-shaped sliding surfaces 5 are negatively inclined at the angles $\alpha_3$ and $\alpha_4$. These angles may be the same ($\alpha_3=\alpha_4$) or, if necessary, even different. Optimal angles $\alpha_3$ and $\alpha_4$ may be determined in dependence upon the viscosity of the liquid coating materials, their number and the quantities applied. The angles are generally in the range of from 30° to 60°. Tests have shown that good results are also obtained when for example $\alpha_3$ is 90° and the other angle of the sliding surface $\alpha_4$ is between 30° and 60°.

It has also surprisingly been found that the liquid coating materials flowing down at 90° from the vertical sliding surface 10 are free from disturbances and do not show any signs of mixing or separation providing they are suddenly slowed down from a relatively high rate of flow down the vertical sliding surface 10 to a slower rate of flow along the V-shaped sliding surfaces 5 although, in that case, the layers increase in thickness.

Even when the discharge edge 4 is reached and the curtain is formed, no disturbance or signs of mixing occur, irrespective of the angles $\alpha_3$ and $\alpha_4$ in the above-mentioned range. By virtue of the fact that the coating materials 11 are combined at the edge 4, a particularly stable curtain 3 is obtained. During the free fall a of the curtain 3 onto the layer support, the liquid layers falling together reach a speed Va largely dependent on the height of fall a in accordance with the following formula:

$$V(a) = \sqrt{Vo^2 + 2\,g \cdot a}$$

whereby Vo is the initial speed and g is the acceleration due to gravity and V(a) is the speed by the time the layers arrive at the layer support 1. Since only laminar flows occur throughout the entire curtain, the individual layers are not mixed either during the free fall or when the curtain arrives on the layer support.

Surprisingly, the layer support 1 may be moved within certain limits at a lower speed than the speed Va at which the curtain 3 impinges thereon, so that an increase in the thickness of the layers 2 applied is obtained, or at the same speed as the curtain at its point of contact with the web, in which case there is no increase in the thickness of the layers coated. It is advantageous for the layer support 1 to be moved at a speed considerably higher than that at which the curtain 3 impinges on it. In this way, it is possible through the elongation of the layers 2 applied to obtain extremely thin layers of the type required in the photographic industry for the production of multi-layer colour materials.

In order to prevent the curtain from fluttering during its free fall, the entire coating unit is protected against draughts by a transparent hood of the type generally used in the curtain coating field.

A layer support 1 moving at high speed drags air along at its surface, with the result that disturbances attributable to inclusions of air can occur at the point of contact between the curtain 3 and the layer support 1. It is known that deflection plates, extraction systems or baffles may be arranged over the web in order largely to eliminate disturbances of this nature.

It is advantageous to guide and support the layer support 1 at the line where the curtain comes into contact with it in such a way that troublesome fluttering of the layer support 1 is avoided. This may be done in conventional manner by means of a roller 6, a plate or the like. It is particularly advantageous to loop the layer support 1 around the roller 6 before and/or after the line at which the curtain 3 falls onto it in order to stabilise the layer support 1.

One advantage common to all the embodiments lies in the absence of a discharge lip. In every case, the coating edge is completely surrounded by the coating materials. This avoids the disturbances and losses which occur at the discharge lips of slot coaters and nozzle coaters. It must be regarded as surprising to the expert that several layers are able to adhere to the underside of a surface and to flow downwards to the coating edge.

With these apparatus, it is possible to coat objects of any kind with a plurality of layers and with a variety of different coating materials providing they can be passed through below the coating unit.

In principle, the process according to the invention may be used for coating glass, wood or fabrics. Similarly, it is possible to coat layer supports in the form of sheets or films rather than continuous webs. As already mentioned, the process and apparatus are particularly suitable for coating photographic layer supports with photographic emulsions.

According to the invention, any standard web-form materials may be used as layer supports for the production of photographic materials. Examples of layer supports such as these are films of cellulose nitrate, cellulose triacetate, polyvinyl acetate, polycarbonate, polyethylene terephthalate, polystyrene and the like, and a variety of different coated or uncoated papers.

By virtue of the process according to the invention, it is not only possible to apply photographic layers containing silver halides as photosensitive compounds, but it is also possible to produce layers containing photosensitive dyes or photoconductive zinc oxide or titanium dioxide.

The layers may also contain other additives of the type commonly used in the production of photographic layers, for example carbon black, matting agents, such as silicon dioxide, or polymeric development aids, mordants and the like. Photographic layers may also contain various hydrophilic colloids as binders. Apart from proteins, such as gelatin, examples of colloids such as these are cellulose derivatives, polysaccharides, such as starch, sugar, dextrin or agar-agar, and also synthetic polymers, such as polyvinyl alcohol or polyacrylamide, or mixtures of these binders.

In addition, the coating process according to the invention may also be used for the production of non-photographic layers, such as for example magnetic tape layers or other paint or lacquer layers.

Figure 2:
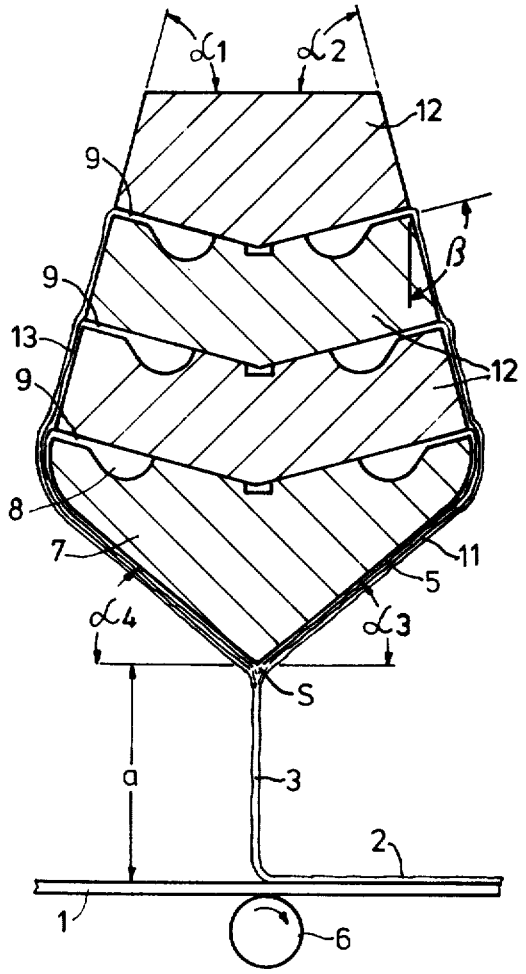
FIG. 2 is a section through an improved coating unit with roof-like sliding surfaces.

FIG. 2 shows a modification of FIG. 1 in which the vertical sliding surfaces 10 are replaced by roof-like sliding surfaces 13. The angles $\alpha_1$ and $\alpha_2$ are smaller than 90°, i.e. between 60° and 90° and preferably of the order of 80°. In this embodiment, the outlet slots 9 are directed upwards (angle $\beta$ more than 90°), so that better venting of the feed passages 8 and the outlet slots 9 is obtained because, when the coating unit is started up, the air is more effectively displaced from the liquid.

The flow conditions are more favourable on the roof-like sliding surfaces 13. The coating liquids 11 are continuously diverted from the inclined roof-like sliding surfaces 13 onto the V-shaped sliding surfaces 5 over curved surfaces, so that their rate of flow is continuously changed.

Figure 3:
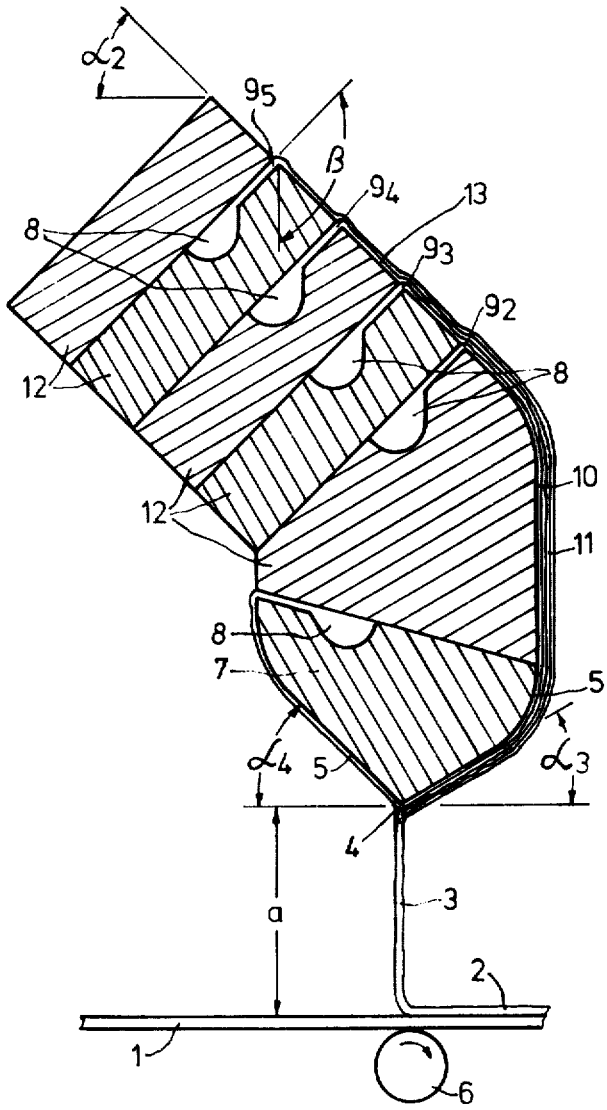
FIG. 3 is a section through one special coating unit with cascade-like discharge.

FIG. 3 shows an embodiment in which the discharge behaviour of the liquid coating materials in the case of cascade coating and the curtain formation according to the invention are combined. Substantially all the layers are formed on the cascade-like sliding surface 13 and, on the other side, only one or even several of the layers is/are delivered to the discharge edge 4. In the cascade coaters, the roof-like sliding surface 13 forms an angle $\alpha_2$ of from 15° to 60°. It is, of course, also possible to use larger angles $\alpha_2$ of up to 90°, so that this embodiment would fit into the embodiment shown in FIG. 1, apart from the fact that the number of layers for the V-shaped sliding surfaces is different. This also lies within the scope of the invention. Neither do the angles of the V-shaped body 7 for the sliding surfaces 5 have to be the same. The angle $\alpha_3$ may be between 30° and 90° and the angle $\alpha_4$ between about 45° and 60°. This coating unit enables several layers to be simultaneously coated, in the same way as a cascade or nozzle coater, but does not have any of their disadvantages.

Figure 4:
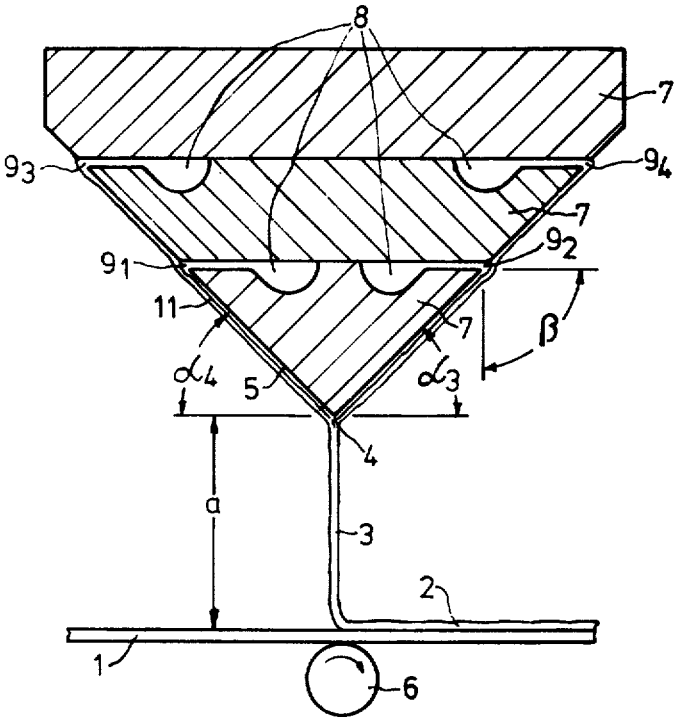
FIG. 4 is a section through a coating unit comprising only V-shaped sliding surfaces.

FIG. 4 shows an embodiment of a coating unit comprising only negatively inclined surfaces. It may be used for applying from 1 to 4 layers. The blocks 7 are relatively simple to produce and the coater is extremely compact. In this case, too, the coating materials 11 are delivered to the front end, and, as shown in FIG. 1, are distributed over the coating width by means of the feed passages 8 and the outlet slots 9.

Figure 5:
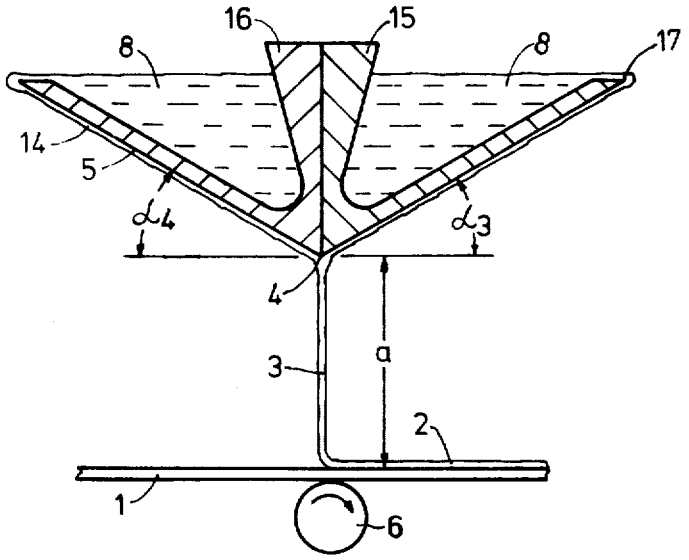
FIG. 5 is a section through a double coating unit comprising a barrier-like overflow.

The embodiment shown in FIG. 5 has the advantage of being extremely simple. The coating materials are delivered in the lower part of the channel-like feed passages 8 and fill the channel-like feed passages 8 up to the barriers 17, which have to be arranged straight and horizontally because the uniformity of the layer thickness over the coating width is determined at these points.

Advantages of this embodiment include the low manufacturing costs of the coater and its ready accessibility for cleaning purposes. In addition, the two surfaces of the layers of the coating materials are kept in contact with the atmosphere for a particularly long period, which again affords the advantage of low surface tensions.

Figure 6:
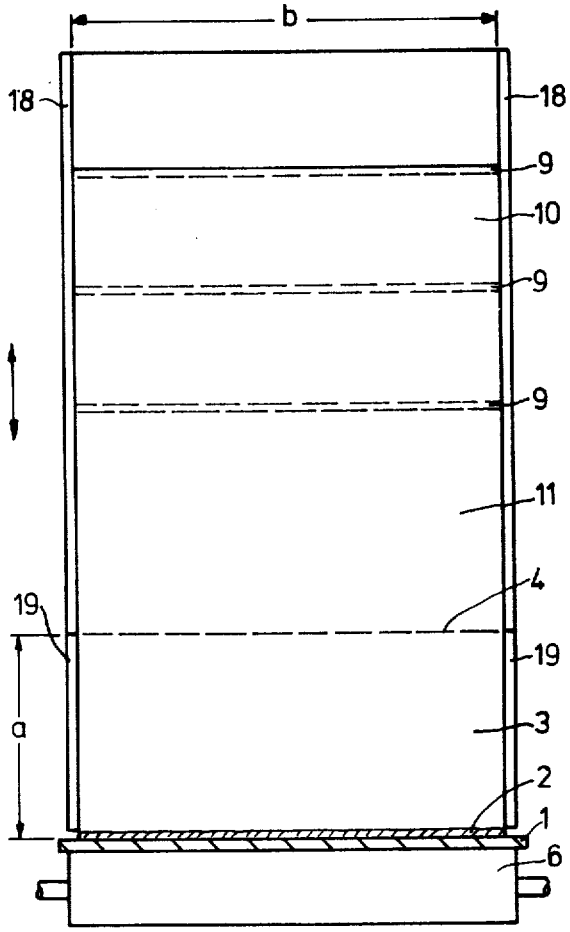
FIG. 6 is a front elevation of the coating unit shown in FIG. 1.

Finally, FIG. 6 is a front elevation of the coating unit shown in FIG. 1. The coating unit is arranged at a distance a above the layer support 1 and has a width b which may be wider than, equal to or narrower than the width of the layer support.

The liquid coating materials 11 issue from the outlet slots 9 onto the sliding surface 10, flow down the sliding surface 10 and are superposed upon one another. To prevent constrictions of the downwardly flowing film, the sliding surfaces 10 and 5 are bordered on both sides by boundary strips 18 to which the film is applied by surface tension. After flowing over the V-shaped sliding surface 5, the visible film of liquid reaches the discharge edge 4 and combines with the film of liquid coming from the non-visible, rear sliding surface to form a curtain 3 which flows vertically by the distance a onto the layer support 1 where it forms the layer 2. To prevent constriction of the curtain 3, lateral guides 19 are provided in conventional manner. The layer support is supported by a roller 6 at the point of contact of the curtain 3. As indicated by the double arrow, the coating unit may be moved up and down to enable an optimum falling height a to be adjusted for the curtain 3. As mentioned above, the falling height a influences the thickness of the curtain on contact with the layer support and also the rate at which it arrives on the layer support. This is essential for forcing the air away from the layer support through the kinetic energy of the falling curtain and for avoiding inclusions of air between the layers 2 and the layer support 1.

Some possible embodiments of experimental coating units are illustrated by the following Examples which only represent a selection and, for this reason, can only provide an idea without any claim to completeness.

The Tables given in the following Examples use symbols having the following meaning:

$\eta$ (mPas): viscosity
O (mN/m): surface tension as measured by a Stalagmometer
$\rho$ ($\mu$m): wet layer thickness on the web
Q (L/m min.): quantity applied in liters per meter per minute
$C_B$ (m/min.): web speed
Em-: particular coating material
a (m): curtain height
$b_1$ (m): curtain width
$b_2$ (m): width of layer support

EXAMPLE 1

A coater of the type shown in FIG. 1 was used for one-layer coating. The coating data are shown in the following Table:

| | Slot 9,1 | Slot 2 | Slot 3 | Slot 4 | Slot 5 | Slot 6 | $C_B$ | a |
|---|---|---|---|---|---|---|---|---|
| $E_m$ | green/ red aqueous gelatin solution | | | | | | | |
| $\eta$ | 8 | | | | | | 200 | 0.13 |
| O | 27 | | | | | | | |
| $\rho$ | 31 | | | | | | | |
| Q | 7.8 | | | | | | | |

The coating quality was satisfactory. The curtain was not particularly stable and tended to curve over the width.

EXAMPLE 2

A coater of the type shown in FIG. 1 was used for two-layer coating.

| | Slot 9,1 | Slot 9,2 | Slot 3 | Slot 4 | Slot 5 | Slot 6 | $C_B$ | a |
|---|---|---|---|---|---|---|---|---|
| $E_m$ | aqueous gelatin/ silver halide emulsion | clear aqueous gelatin solution | | | | | 200 | 0.13 |
| $\eta$ | 19.5 | 13.8 | | | | | | |
| O | 27 | 27.7 | | | | | | |
| $\rho$ | 48 | 26 | | | | | | |
| Q | 9.6 | 5.2 | | | | | | |

The coating quality was good, and the curtain was stable and steady.

EXAMPLE 3

A coater of the type shown in FIG. 1 was used for four-layer coating.

| | Slot 9,1 | Slot 9,2 | Slot 9,3 | Slot 9,4 | Slot 9,5 | Slot 9,6 | $C_B$ | a |
|---|---|---|---|---|---|---|---|---|
| $E_m$ | blue aqueous gelatin solution | as 9,1 | as 9,1 | | as 9,1 | | | |
| $\eta$ | 13.5 | 13.5 | 13.5 | | 13.5 | | 100 | 0.13 |
| O | 26 | 26 | 26 | | 26 | | | |
| $\rho$ | 35 | 25 | 25 | | 15 | | | |
| Q | 3.5 | 2.5 | 2.5 | | 1.5 | | | |

The coating quality was good. The curtain was stable.

EXAMPLE 4

A coater of the type shown in FIG. 1 was used for six-layer coating.

| | Slot 9,1 | Slot 9,2 | Slot 9,3 | Slot 9,4 | Slot 9,5 | Slot 9,6 | $C_B$ | a |
|---|---|---|---|---|---|---|---|---|
| $E_m$ | red aqueous gelatin solution | clear aqueous gelatin solution | as 9,2 | as 9,1 | green aqueous gelatin solution | as 9,2 | | |
| $\eta$ | 20 | 9.5 | 9.5 | 20 | 16 | 9.5 | 100 | 0.13 |
| O | 26 | 26.2 | 26.2 | 26 | 26.7 | 26.2 | | |
| $\rho$ | 20 | 12 | 12 | 20 | 15 | 12 | | |
| Q | 2.0 | 1.2 | 1.2 | 2.0 | 1.5 | 1.2 | | |

The coating quality was good. A microphotograph of a cross-section through the dried coating showed very clean separation between the layers. The curtain was very stable.

EXAMPLE 5

A coater of the type shown in FIG. 4 was used for two-layer coating.

| | Slot 9,1 | Slot 9,2 | Slot 9,3 | Slot 9,4 | Slot 9,5 | Slot 9,6 | $C_B$ | a |
|---|---|---|---|---|---|---|---|---|
| $E_m$ | blue aqueous gelation solution | | | | | | | |
| $\eta$ | 10 | | as 9,1 | | | | | |
| O | 26.7 | | | | | | 150 | 0.115 |
| $\rho$ | 33 | | | | | | | |
| Q | 5.0 | | | | | | | |

The coating quality was satisfactory. The curtain was not particularly stable and tended to curve over the width.

EXAMPLE 6

A coater of the type shown in FIG. 4 was used for three layer coating.

| | Slot 9,1 | Slot 9,2 | Slot 9,3 | Slot 9,4 | Slot 9,5 | Slot 9,6 | $C_B$ | a |
|---|---|---|---|---|---|---|---|---|
| $E_m$ | blue aqueous gelatin solution | as 9,1 | as 9,1 | | | | | |
| $\eta$ | 10 | 10 | 10 | | | | 150 | 0.115 |
| O | 26.7 | 26.7 | 26.7 | | | | | |
| $\rho$ | 17 | 17 | 20 | | | | | |
| Q | 2.5 | 2.5 | 3.0 | | | | | |

The coating quality was good. The curtain was stable.

EXAMPLE 7

A coater of the type shown in FIG. 1 was used for two-layer coating.

| | Slot 9,1 | Slot 9,2 | Slot 9,3 | Slot 9,4 | Slot 9,5 | Slot 9,6 | $C_B$ | a |
|---|---|---|---|---|---|---|---|---|
| $E_m$ | aqueous gelatin/ silver halide emulsion | clear aqueous gelatin solution | | | | | | |
| $\eta$ | 44 | 14.4 | | | | | 100 | 0.13 |
| O | 33 | 27.5 | | | | | | |
| $\rho$ | 60 | 25 | | | | | | |
| Q | 6.0 | 2.5 | | | | | | |

The coating quality was good. The curtain was stable.

EXAMPLE 8

A coater of the type shown in FIG. 1 was used for three-layer coating.

| | Slot 9,1 | Slot 9,2 | Slot 9,3 | Slot 9,4 | Slot 9,5 | Slot 9,6 | $C_B$ | a |
|---|---|---|---|---|---|---|---|---|
| $E_m$ | aqueous gelatin/ silver halide emulsion | as 9,1 | | clear aqueous gelatin solution | | | | |
| $\eta$ | 38 | 29 | | 11 | | | 100 | 0.13 |
| O | 31.6 | 29.2 | | 25.7 | | | | |
| $\rho$ | 46 | 21 | | 26 | | | | |

-continued

| | Slot 9,1 | Slot 9,2 | Slot 9,3 | Slot 9,4 | Slot 9,5 | Slot 9,6 | $C_B$ | a |
|---|---|---|---|---|---|---|---|---|
| Q | 4.6 | 2.1 | | 2.6 | | | | |

The coating quality was good. The curtain was stable and steady.

EXAMPLE 9

The coater shown in FIG. 1 was used for two-layer coating.

| | Slot 9,1 | Slot 9,2 | Slot 9,3 | Slot 9,4 | Slot 9,5 | Slot 9,6 | $C_B$ | a |
|---|---|---|---|---|---|---|---|---|
| $E_m$ | green aqueous gelatin solution | as 9,1 | | | | | | |
| $\eta$ | 14 | 14 | | | | | 200 | 0.03 |
| O | 26.7 | 26.7 | | | | | | |
| $\rho$ | 22.5 | 22.5 | | | | | | |
| Q | 4.5 | 4.5 | | | | | | |

The coating quality was good. The curtain was steady and stable.

EXAMPLE 10

The coater shown in FIG. 1 was used for three-layer coating.

| | Slot 9,1 | Slot 9,2 | Slot 9,3 | Slot 9,4 | Slot 9,5 | Slot 9,6 | $C_B$ | a |
|---|---|---|---|---|---|---|---|---|
| $E_m$ | green aqueous gelatin solution | red aqueous gelatin solution | yellow aqueous gelatin solution | | | | | |
| $\eta$ | 14 | 10 | 6.8 | | | | | |
| O | 26.7 | 27 | 26 | | | | 60 | 0.03 |
| $\rho$ | 58.3 | 25 | 25 | | | | | |
| Q | 3.5 | 1.5 | 1.5 | | | | | |

The coating quality was good. The separation between the layers was very clean, as shown by a cross-section through the dried coating. The curtain was stable.

EXAMPLE 11

The coater shown in FIG. 1 was used for a two-layer coating.

| | Slot 9,1 | Slot 9,2 | Slot 9,3 | Slot 9,4 | Slot 9,5 | Slot 9,6 | $C_B$ | a |
|---|---|---|---|---|---|---|---|---|
| $E_m$ | aqueous gelatin silver halide solution | clear aqueous gelatin solution | | | | | | |
| $\eta$ | 11.8 | 13.2 | | | | | 200 | 0.04 |
| O | 26.2 | 27.7 | | | | | | |
| $\rho$ | 42 | 25 | | | | | | |
| Q | 8.4 | 5.0 | | | | | | |

The coating quality was good. The curtain was stable.

EXAMPLE 12

A coater of the type shown in FIG. 3 was used for two-layer coating. The angles were: $\alpha_2=24°$, $\alpha_3=90°$, $\alpha_4=45°$.

| | Slot 9,1 | Slot 9,2 | Slot 9,3 | Slot 9,4 | Slot 9,5 | Slot 9,6 | $C_B$ | a |
|---|---|---|---|---|---|---|---|---|
| $E_m$ | blue aqueous gelatin solution | as 9,1 | | | | | | |
| $\eta$ | 13 | 13 | | | | | | |
| O | 25 | 25 | | | | | 150 | 0.040 |
| $\rho$ | 26 | 26 | | | | | | |
| Q | 4 | 4 | | | | | | |

The coating quality was good. The curtain was stable.

EXAMPLE 13

A coater of the type shown in FIG. 3 was used for two-layer coating. The angles were: $\alpha_2=24°$, $\alpha_3=45°$, $\alpha_4=55°$.

| | Slot 9,1 | Slot 9,2 | Slot 9,3 | Slot 9,4 | Slot 9,5 | $C_B$ | a |
|---|---|---|---|---|---|---|---|
| $E_m$ | green aqueous gelatin solution | as 9,1 | | | | | |
| $\eta$ | 12,5 | 12,5 | | | | | |
| O | 26 | 26 | | | | 150 | 0.040 |
| $\rho$ | 34 | 34 | | | | | |
| Q | 5.2 | 5 | | | | | |

The coating quality was good. The curtain was stable.

EXAMPLE 14

The coater shown in FIG. 3 was used for two-layer coating. The angles $\alpha_2$, $\alpha_3$, $\alpha_4$ were the same as in Example 13.

| | Slot 9,1 | Slot 9,2 | Slot 9,3 | Slot 9,4 | Slot 9,5 | $C_B$ | a |
|---|---|---|---|---|---|---|---|
| $E_m$ | red aqueous gelatin solution | | | green aqueous gelatin solution | | | slots 9,2 & 9,3 were flooded |
| $\eta$ | 20 | | | 10 | | 150 | 0.040 |
| O | 24.2 | | | 25.8 | | | |
| $\rho$ | 26 | | | 40 | | | |
| Q | 4 | | | 6 | | | |

The coating quality was good and the separation between the dried layers was very clean. The curtain was stable.

The preceding Examples represent the main area of application. Higher speeds of travel of the supports and larger numbers of layers are possible providing the coating parameters are adapted accordingly. The advantages explained above are confirmed by the quality of coating. The separation between the layers applied was very clean and, as shown by numerous photographs, there was no mixing between the layers after drying.

The process according to the present invention is distinguished with advantage from conventional coating processes by an improvement in the quality of coating and by a reduction in the losses of material and in the number of production stoppages. The advantages are probably attributable to the fact that the two surfaces of the films produced by the coater are in contact with the atmosphere for a relatively long period before application so that wetting agents present in the coating material rectify and minimise the surface tensions. The flow conditions at the coating edge are symmetrical. As a result, the stability of the curtain can be considerably increased and this in turn improves the quality of coating. In addition, a larger number of layers can be applied in a single passage by the process according to the invention, in addition to which a particularly steadily flowing curtain and high coating speeds with thin, cleanly separated layers are obtained both with small and with large dropping heights of the curtain.

1. Layer support
2. Layer applied
3. Curtain
4. Discharge edge
5. V-shaped sliding surfaces
6. Supporting roller
7. V-shaped body
8. Feed passages
9. Outlet slots
10. Vertical sliding surface
11. Liquid coating materials
12. Delivery means for coating materials
13. Roof-like sliding surfaces
14. Liquid coating material
15. V-shaped container
16. Partition
17. Overflow barrier
18. Boundary strip on the sliding surfaces
19. Lateral curtain guide

We claim:

1. A process for simultaneously applying several layers of liquid coating materials in a coating width in a coating device in the absence of a discharge lip to layer-supporting materials moving continuously past a point of application, characterized in that in a sole coating device more than two films of liquid coating materials are uniformly distributed over V-formed, vertical, curved or roof-like slide surfaces arranged and joined on V-shaped surfaces over the coating width, the films of liquids flowing on both sides to the V-shaped surfaces in the form of a single layer or more layers, one upon another and along the negatively inclined surfaces of the V-shaped coater, terminating at a junction constituting discharge edge and the films of liquids from both sides of the V-shaped body being combined at a discharge edge to form a multiple layer film of liquids which deposits directly from the discharge edge without contact with a lip and in the form of a free-falling curtain onto the moving layer supporting material in a stable coating having several substantial separate layers whereby the period of flow of the films over the slide surfaces and the freely fall enable the surface tension in the film of liquids to be reduced and the free falling curtain of films to be stabilized.

2. A process as claimed in claim 1, characterised in that the free-falling curtain is protected against movements of air during its free fall and its arrival on the layer support.

3. An apparatus for simultaneously applying more than two layers of liquid coating materials in a vertical free-falling multi-layer curtain directly in the absence of discharge lips to a layer-supporting material moved continuously past a junction under the free-falling curtain, wherein on one side of the V-shaped body at least two delivery means are provided on the vertical curved roof-like slide surface to deliver at least two films of coating material to the discharge edge of the V-shaped body and wherein on the other side of the V-shaped body one delivery means is arranged to deliver one film of coating material to the discharge edge and whereby the films from both sides are combined at the discharge edge and deposited directly from the discharge edge into the form of a free-falling curtain onto the moving supporting material.

4. An apparatus as set forth in claim 3, wherein outlet slots are connected to the delivery means and the outlet slots are upwardly inclined above the horizontal, whereby bubbles in the delivered liquids are eliminated.

5. An apparatus as set forth in claim 4, wherein at least one of the additonal slide surfaces is curved.

* * * * *